US009549272B2

(12) United States Patent
Deng et al.

(10) Patent No.: US 9,549,272 B2
(45) Date of Patent: Jan. 17, 2017

(54) MULTIFUNCTIONAL DEVICE FOR ASSEMBLY AND TEST OF WIRE-CONTROL EARPHONE

(71) Applicant: Goertek, Inc., Weifang, ShanDong Province (CN)

(72) Inventors: Shoubiao Deng, Weifang (CN); Shuliang Gong, Weifang (CN); Baohui Song, Weifang (CN)

(73) Assignee: Goertek, Inc., Weifang, Shandong Province (CN)

( * ) Notice: Subject to any disclaimer, the term of this patent is extended or adjusted under 35 U.S.C. 154(b) by 0 days.

(21) Appl. No.: 14/761,722

(22) PCT Filed: Sep. 3, 2013

(86) PCT No.: PCT/CN2013/082836

§ 371 (c)(1),
(2) Date: Jul. 17, 2015

(87) PCT Pub. No.: WO2014/127622

PCT Pub. Date: Aug. 28, 2014

(65) Prior Publication Data

US 2015/0358751 A1 Dec. 10, 2015

(30) Foreign Application Priority Data

Feb. 19, 2013 (CN) ..... 2013 1 0053663

(51) Int. Cl.
*H04R 29/00* (2006.01)
*H04R 1/10* (2006.01)
*H04R 31/00* (2006.01)

(52) U.S. Cl.
CPC ..... *H04R 29/00* (2013.01); *H04R 1/1058* (2013.01); *H04R 31/00* (2013.01); *H04R 2420/07* (2013.01)

(58) Field of Classification Search
CPC ..... H04R 29/00; H04R 1/1058; H04R 31/00; H04R 2420/07; H04R 25/30; H04R 2460/00

(Continued)

(56) References Cited

U.S. PATENT DOCUMENTS 4,038,500 A * 7/1977 Frye ..... H04R 29/001 381/361
5,400,406 A * 3/1995 Heline, Jr. ..... G01R 31/2825 381/58

(Continued)

FOREIGN PATENT DOCUMENTS

CN 101907660 A * 12/2010 ..... G01R 31/00
CN 102026083 A * 4/2011 ..... H04R 29/00

(Continued)

OTHER PUBLICATIONS

Winston, "Headphone Repair: Finding and Fixing a Wire Break", http://www.winstonmoy.com/2013/01/headphone-repair-finding-and-fixing-a-wire-break/, p. 1-7, Jan. 3, 2013.*

(Continued)

*Primary Examiner* — Leshui Zhang
(74) *Attorney, Agent, or Firm* — Boyle Fredrickson, S.C.

(57) ABSTRACT

The present invention discloses a multifunctional device for assembly and test of wire-control earphone, belonging to the technical field of assembly and test device of electronic products, comprising an operating platform, and a wire-control component region and a wire slot are provided on the upper surface of the operating platform, the assembly of wire-control earphone can be achieved by the operating platform; and touch control holes are provided in the wire-control component region, the touch control holes are in one-to-one correspondence with rods, each of the rods has a touch control end and an operating end, a socket is provided on the operating platform, the socket is connected to a circuit (Continued)

board, a signal transmitting elastic sheet is provided on the circuit board, and after an earphone plug is inserted into the socket, by pressing the operating end of the rod, the touch control terminal comes into contact with the contact point on the wire-control earphone, then through the signal transmitting elastic sheet on the circuit board, a signal is transmitted to an outer test device, thereby the test of the wire-control earphone is completed. The examples of the present invention can achieve the assembly and test of wire-control earphone, and achieve the universality of work device between different work stations, thus improve production efficiency greatly.

6 Claims, 4 Drawing Sheets

(58) Field of Classification Search
USPC .... 381/56, 58, 59, 60, 74; 455/67.11, 67.12, 455/115.1, 116, 226.1; 700/94; 74/502.5, 74/490.02, 502.6
See application file for complete search history.

(56) References Cited

U.S. PATENT DOCUMENTS 5,791,671 A * 8/1998 Tang ..... B62K 21/18 280/264
6,532,296 B1 * 3/2003 Vaudrey ..... G10K 11/1788 381/371
7,870,928 B1 * 1/2011 Jiang ..... H04R 1/2815 181/148
2009/0122996 A1 * 5/2009 Klein ..... H04R 29/00 381/56
2011/0290065 A1 * 12/2011 Ehrenreich ..... B62B 7/12 74/502.6
2012/0139674 A1 * 6/2012 Wu ..... H01H 50/14 335/189
2012/0320546 A1 * 12/2012 Wu ..... H02G 11/02 361/755

FOREIGN PATENT DOCUMENTS

CN 201967131 U * 9/2011 ..... H04R 29/00
CN 201995130 U * 9/2011 ..... H04R 29/00
CN 102572671 A * 7/2012 ..... H04R 29/00
CN 102857853 1/2013

OTHER PUBLICATIONS

PCT/CN2013/082836, Written Opinion of the International Searching Authority dated Dec. 12, 2013, 5 pages and English Translation, 4 pages.

* cited by examiner

MULTIFUNCTIONAL DEVICE FOR ASSEMBLY AND TEST OF WIRE-CONTROL EARPHONE

TECHNICAL FIELD

The present invention relates to the technical field of assembly and test device for electronic products, in particular relates to a multifunctional device for the assembly and test of wire-control earphone.

BACKGROUND ART

In recent years, with the escalation of human's consumption attitudes, many consumers want to operate the phone or the player mostly with the wire-control components of earphone, which then raises a higher requirement to the design and production of wire-control earphone.

Currently, the production and test of wire-control earphone is moving towards an automatic and intelligent direction, and during the production process of wire-control earphone, the assembly and test of wire-control earphone should be completed at different work stations for installating, testing and so on, different devices are required to accommodate and test the earphone at different work stations, which is not only low in productivity, but also easy to damage the wire-control components of earphone, thus there is an urgent need for a multifunctional device capable of running through the entire production process.

SUMMARY OF THE INVENTION

The technical problem to be solved by the present invention is to provide a multifunctional device for assembly and test of wire-control earphone, to solve the problem of low productivity due to the fact that the work device cannot be used in common between different work stations during the production process of wire-control earphone.

To solve the above problem, the technical solution of the present invention is: a multifunctional device for assembly and test of wire-control earphone, comprising an operating platform, a wire-control component region for disposing a-wire-control components of earphone and a wire slot for disposing an earphone wire are provided, on the upper surface of the operating platform, several touch control holes corresponding to contact points on the wire-control earphone are provided in the wire-control component region of the operating platform, several rods are slidably mounted on the operating platform, the rods are in one-to-one correspondence with touch control holes, each of the rod has a touch control end corresponding to a touch control hole and an operating end protruding from the operating platform; a socket for connection to an earphone plug is provided on the operating platform, the socket is connected to a circuit board, a signal transmitting elastic sheet is provided on the circuit board.

As an improvement, the operating platform comprises a box body and an upper cover assembled fixedly as a whole, the wire-control component region, the wire slot and the touch control holes are provided on the upper cover, rod bushes are provided in the box body, the rod bushes and the box body are configured as a whole, the rods are slidably mounted in the rod bushes.

As a further improvement, an installation chamber for fixedly installing the socket and the circuit board is provided in the box body, an earphone plug connection channel for connecting the earphone plug to the socket is provided on the box body, a test probe connection hole is provided on the upper cover, the test probe connection hole corresponds to the position of the signal transmitting elastic sheet.

As further improvement, the end of the signal transmitting elastic sheet is provided in the test probe connection hole.

As a further improvement, a rod cover for restricting the rods within the rod bushes is provided on the box body, the operating ends of the rods protrude from the rod cover, reset springs are provided between the touch control ends of the rods and the rod bushes.

As a further improvement, a container for accommodating earphone wire or other members is provided in the operating platform, the container is provided on one side of the wire-control component region.

As a further improvement, a wear-resistant bottom plate is provided at the bottom of the operating platform.

The above technical solution of the present invention can achieve the following beneficial effects: since the multifunctional device for assembly and test of wire-control earphone comprises an operating platform, and a wire-control component region and a wire slot are provided on the upper surface of the operating platform, the assembly of the wire-control earphone can be achieved by the operating platform; meanwhile, since touch control holes are provided in the wire-control component region, the touch control holes are in one-to-one correspondence with rods, each of the rods has a touch control end and an operating end, a socket is provided on the operating platform, the socket is connected to a circuit board, a signal transmitting elastic sheet is provided on the circuit board, after an earphone plug is inserted into the socket, by pressing the operating end of the rod, the touch control terminal comes into contact with the contact point on the wire component, then through the signal transmission elastic sheet on the circuit board, a signal is transmitted to an outer test device, thereby the test of the wire-control earphone is completed; therefore, the multifunctional device for assembly and test of wire-control earphone can achieve the assembly and test of the wire-control earphone, and achieve the universality of work device between different work stations, thus improve production efficiency greatly.

Since the operating platform comprises a box body and an upper cover, the wire-control component region, the wire slot and the touch control holes are provided on the upper cover, rod bushes are provided in the box body, the rod bushes and the box body are configured as a whole, and the rods are slidably mounted in the rod bushes, by configuring the operating platform as a separable structure, a corresponding upper cover can be replaced according to the type of earphone, thereby improving the universality of the operating platform.

Since the installation chamber and the earphone plug connection channel are provided in the box body, the test probe connection hole is provided on the upper cover, and the test probe connection hole correspond to the position of the test probe connection terminal, the socket and circuit board can be installed in the installation chamber in a compact structure, thereby saving the space greatly.

Since the end of the signal transmitting elastic sheet is provided in the test probe connection hole, a signal from the circuit board can be transmitted to the upper cover through the signal transmitting elastic sheet, and the probe of outer test device is only required to be connect to the test probe connection hole of the upper cover, which is convenient to operate.

Since the rod cover for restricting the rod within the rod bush is provided on the box body, the operating ends of the rods protrude from the rod cover, and reset springs are provided between the touch control ends of the rods and the rod bushes, when a touch control end comes into contact with a contact point on the wire-control earphone, the reset spring plays a suffering action, preventing the contact points on the wire-control earphone from damaging, and the rod can be reset automatically upon the action of the reset spring, which is convenient to operate with a simple structure.

Since a container is provided in the operating platform, and the container is provided on one side of the wire-control component region, the container can be used for accommodating earphone wire or other members, which is convenient to operate and assuring the neatness of production line.

Since a wear-resistant bottom plate is provided at the bottom of the operating platform, the box body can be prevented from abrasion during the delivering process of production line, which affects the precision of positioning.

DESCRIPTION OF REFERENCE CHARACTERS

1: operating platform; 11: box body; 12: upper cover; 13: locating hole; 14: locating pin bush; 15: earphone plug connection channel; 16: test probe connection hole; 17: container; 18: wear-resistant bottom plate; 19: connection nut; 2: wire-control component region; 3: wire slot; 4: touch control hole; 5: rod; 51: contact control end; 52: operating end; 53: rod cover plate; 54: reset spring; 6: socket; 7: circuit board; 8: rod bush; 9: installation chamber; 10: signal transmitting elastic sheet

DETAILED DESCRIPTION OF THE INVENTION

To make the purpose, technical solution and advantages of the present invention clearer, the present invention will be further described in details with reference to the drawings and examples. It should be understood that, the specific examples described herein are only for illustrating the present invention, and not for limiting the present invention.

Figure 1:
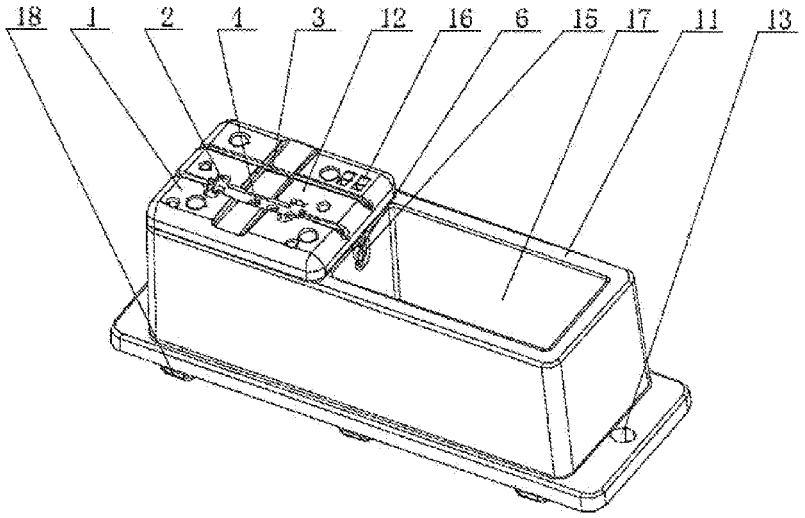
FIG. 1 is a schematic structural diagram of an example of the present invention.
Figure 2:
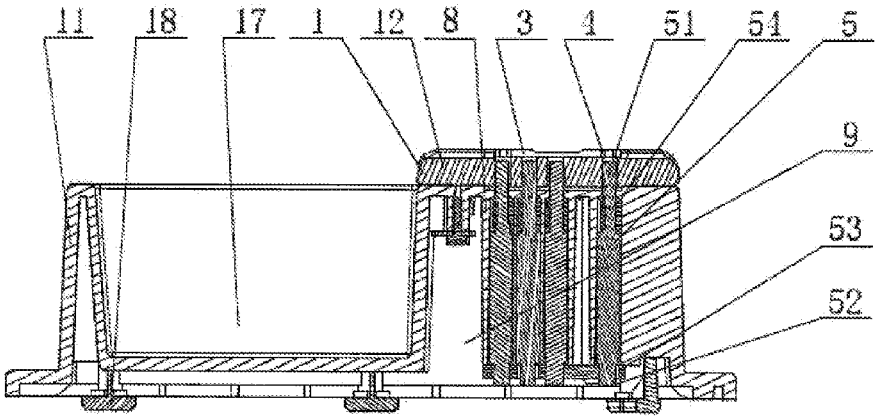
FIG. 2 is a longitudinal sectional schematic structural diagram of FIG. 1.
Figure 3:
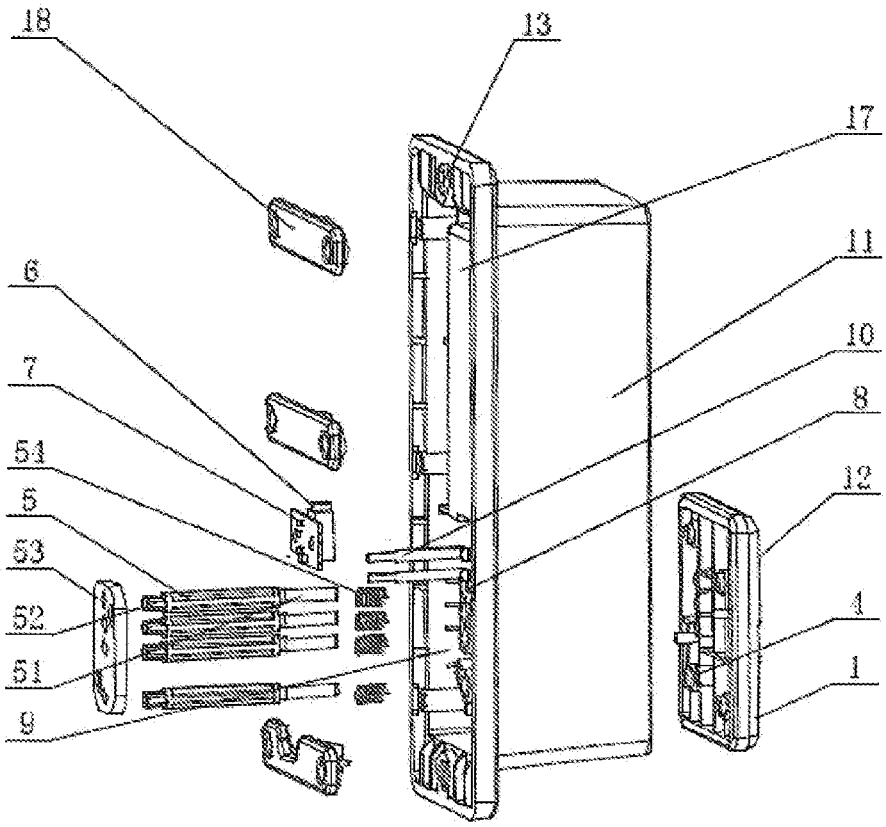
FIG. 3 is an exploded schematic structural diagram of FIG. 1.
Figure 4:
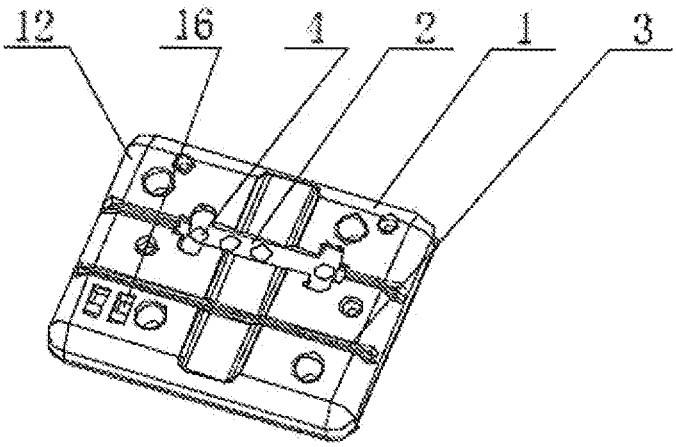
FIG. 4 is a schematic structural diagram of the front surface of the upper cover.
Figure 5:
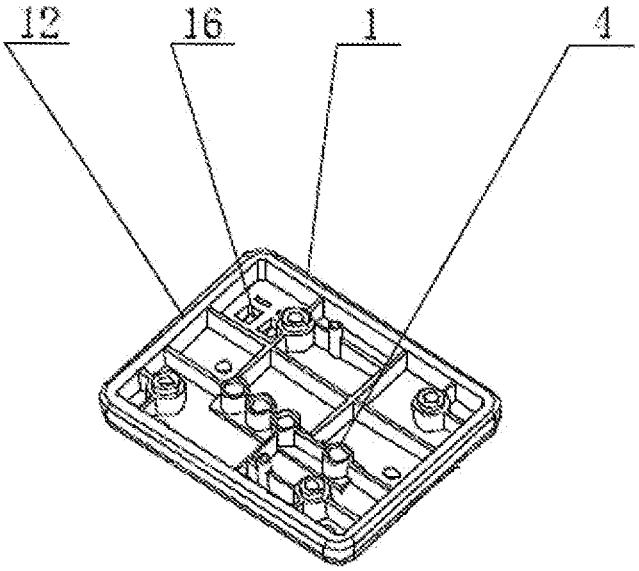
FIG. 5 is a schematic structural diagram of the back surface of the upper cover.
Figure 6:
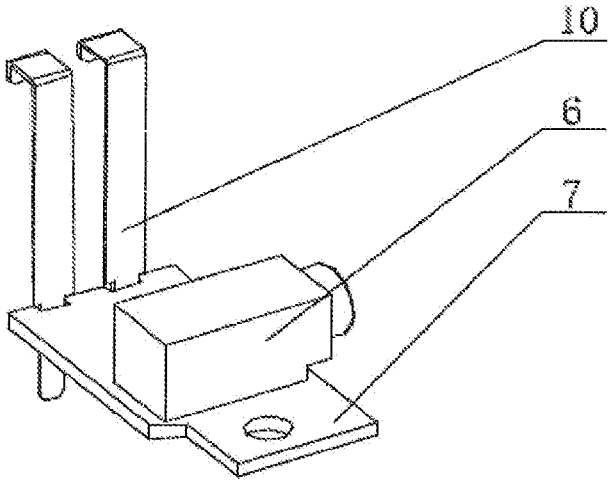
FIG. 6 is a schematic structural diagram of the socket, the circuit board and the signal transmitting elastic sheet.

As shown in FIGS. 1, 2 and 3, a multifunctional device for assembly and test of wire-control earphone comprises an operating platform 1, and a wire-control component region 2 for disposing a wire-control components of earphone and a wire slot 3 for disposing an earphone wire are provided on the upper surface of the operating platform 1, the earphone wire is placed in the wire slot 3 to prevent other devices damaging the earphone wire, several touch control holes 4 corresponding to the contact points on the wire-control earphone are provided on the wire-control component region 2 of the operating platform 1, several rods 5 are slidably mounted on the operating platform 1, the rods 5 are in one-to-one correspondence with touch control holes 4, each of the rods 5 has a touch control end 51 corresponding to a touch control hole 4 and an operating end 52 protruding from the operating platform 1; a socket 6 for connection to a earphone plug is provided on the operating platform 1, the socket 6 comprises plug socket or USB socket, the socket 6 is connected to circuit board 7, a signal transmitting elastic sheet is provided on the circuit board 7.

As shown in FIGS. 3-7, the operating platform 1 comprises a box body 11 and an upper cover 12 assembled fixedly as a whole, the wire-control component region 2, the wire slot 3 and the touch control hole 4 are provided on the upper cover 12, rod bushes 8 are installed in the box body 11, the rod bushes 8 and the box body 11 are configured as a whole, the rods 5 are slidably mounted in the rod bushes 8. By configuring the operating platform 1 as a separable structure, a suitable upper cover 12 can be selected according to the diameter of the earphone wire, the size of the wire-control earphone and the number of the contact points, to meeting the requirement for assembly of earphone with different diameter of wire and different size of the wire-control earphone thus improving the universality of operating platform. Locating holes 13 are provided on both ends of the box body 11 for locating the box body 11 on various devices, locating pin bushes 14 are embedded in the locating holes 13, the material of the locating pin bushes 14 is stainless steel, which can be used for achieving precise location.

As shown in FIGS. 3-6, an installation chamber 9 for fixedly installing the socket 6 and the circuit board 7 is provided in the box body 11, an earphone plug connection channel 15 for connecting the earphone plug to the socket 6 is provided on the box body 11, a test probe connection hole 16 is provided on the upper cover 12, the test probe connection hole 16 corresponds to the position of the signal transmitting elastic sheet, the socket 6 and circuit board 7 are installed in the installation chamber 9 in a compact structure, thus saving the space greatly. The end of the signal transmitting elastic sheet 10 is provided in the test probe connection hole 16, thereby transmitting a signal from the circuit hoard 7 to the upper cover 12 through the signal transmitting elastic sheet 10, and the probe of outer test device is only required to be connected to the test probe connection hole 16 of the upper cover 12, which is convenient to operate.

As shown in FIG. 3, a rod cover 53 for restricting the rods 5 within the rod hushes 8 is provided on the box body 11, the operating ends 52 of the rods 5 protrude from the rod cover 53, and reset springs 54 are provided between the touch control ends 51 of the rods 5 and the rod bushes 8, thus when a touch control end 51 came into contact with a contact point on the wire-control earphone, the reset spring 54 plays a suffering action, preventing the contact points on the wire-control earphone from damaging, and the rods 5 can reset automatically upon the action of reset spring 54, which is convenient to operate with a simple structure.

Figure 7:
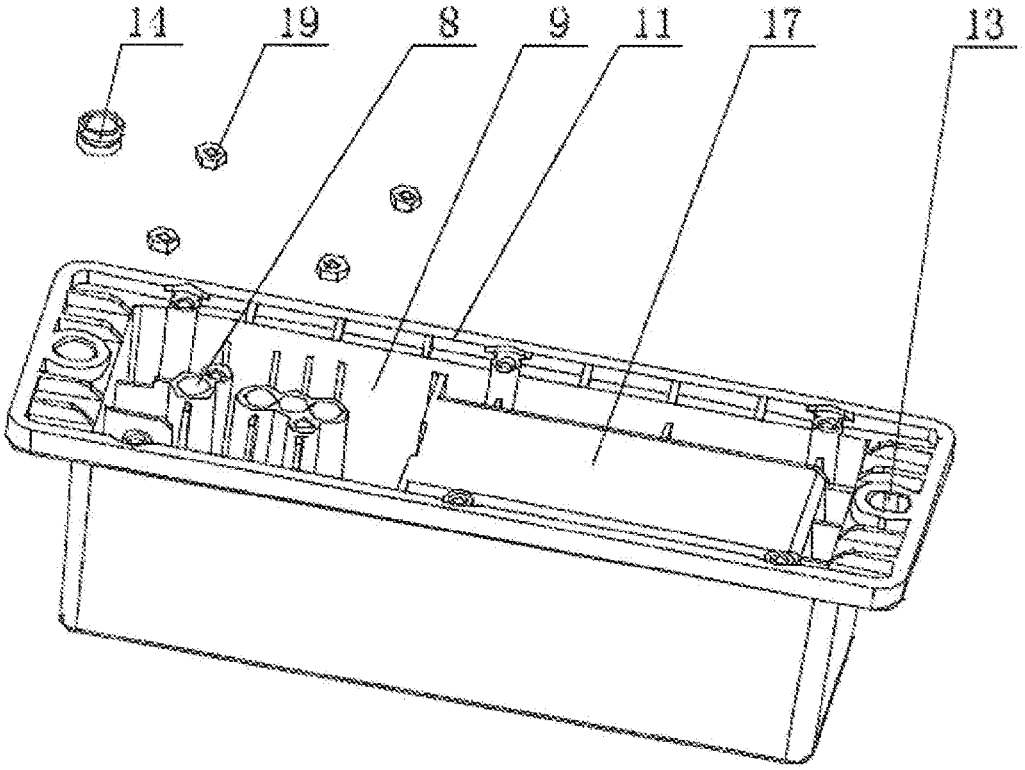
FIG. 7 is an exploded schematic structural diagram of the bottom of the box body.

As shown in FIGS. 1 and 7, a container 17 for accommodating earphone wire or other members is provided in the operating platform 1, the container 17 is provided on one side of the wire-control component region 2, the container 17 is for accommodating earphone wire or other members, and the earphone wire can be wound into circles with a rather small diameter and bound and placed into the container 17, which is convenient to operate and assuring the neatness of production line, a wear-resistant bottom plate 18 is attached to the bottom of the operating platform 1 through a fastener, the fastener comprises a connection nut 19 and a screw, the connection nut 19 is embedded into the box body 11 through inject-molding, preventing the box body from abrasion during the delivering process in the production line, which affects the precision of location.

Since the multifunctional device for assembly and test of wire-control earphone according to the example of the invention comprises an operating platform 1, and a wire-control component region 2 and a wire slot 3 are provided on the upper surface of the operating platform 1, the assembly of the wire-control earphone can be achieved by the operating platform 1; meanwhile, since touch control holes 4 are provided in the wire-control component region 2, the touch control holes 4 are in one-to-one correspondence with rods 5, each of the rods 5 has a touch control end 51 and an operating end 52, a socket 6 is provided on the operating platform 1, the socket 6 is connected to a circuit board 7, a signal transmitting elastic sheet is provided on the circuit board 7, after an earphone plug is inserted into the socket 6, by pressing the operating end 52 of the rod 5, the touch control terminal 51 comes into contact with the contact point on the wire-control earphone, then through the signal transmitting elastic sheet on the circuit board 7, a signal is transmitted to an outer test device, thereby the test of the wire-control earphone is completed; therefore, the multifunctional device for assembly and test of wire-control earphone can achieve the assembly and test of the wire-control earphone, and achieve the universality of work device between different work stations, thus improve production efficiency greatly.

The foregoing description are merely the preferable embodiments of the present invention, are not intended to limit the protection scope of the present invention. Any modification, equivalent replacement and improvement within the spirit and principle of the present invention should fall into the protection scope of the present invention.

The invention claimed is:

1. A multifunctional device for assembly and test of wire-control earphone, comprising:

an operating platform, a wire-control component region for disposing wire-control components of the wire-control earphone and a wire slot for disposing an earphone wire are provided on the upper surface of the operating platform, several touch control holes corresponding to contact points on the wire-control earphone are provided in the wire-control component region of the operating platform;

several rods are slidably mounted on the operating platform, the several rods are in one-to-one correspondence with the several touch control holes, each of the rods has a touch control end corresponding to a touch control hole of the several touch control holes and an operating end protruding from the operating platform; and a socket for connection to an earphone plug is provided on the operating platform, the socket is connected to a circuit board, a signal transmitting elastic sheet is provided on the circuit board;

wherein:

the operating platform includes a box body and an upper cover, which are separable structures and assembled fixedly as a whole, the wire-control component region, the wire slot and the touch control holes are provided on the upper cover, rod bushes are provided in the box body, the rod bushes and the box body are configured as a whole, the rods are slidable mounted in the rod bushes.

2. The multifunctional device for assembly and test of wire-control earphone according to claim 1, characterized in that, an installation chamber for fixedly installing the socket and the circuit board is provided in the box body, an earphone plug connection channel for connecting the earphone plug to the socket is provided on the box body, a test probe connection hole is provided on the upper cover, the test probe connection hole corresponds to a position of the signal transmitting elastic sheet.

3. The multifunctional device for assembly and test of wire-control earphone according to claim 2, characterized in that, an end of the signal transmitting elastic sheet is provided in the test probe connection hole.

4. The multifunctional device for assembly and test of wire-control earphone according to claim 1, characterized in that, a rod cover for restricting the several rods within the rod bushes is provided on the box body, operating ends of the several rods protrude from the rod cover, and reset springs are provided between touch control ends of the several rods and the rod bushes.

5. The multifunctional device for assembly and test of wire-control earphone according to claim 1, characterized in that, a container for accommodating earphone wire or other members is provided in the operating platform, the container is provided on one side of the wire-control component region.

6. The multifunctional device for assembly and test of wire-control earphone according to claim 5, characterized in that, a wear-resistant bottom plate is provided at a bottom of the operating platform.

* * * * *